United States Patent [19]

Kawasaki et al.

[11] Patent Number: 4,473,997

[45] Date of Patent: Oct. 2, 1984

[54] METHOD AND APPARATUS FOR SWITCHING ROVING BOBBINS IN A SPINNING FRAME

[75] Inventors: Yoshio Kawasaki, Fujieda; Tatsutake Horibe, Toyama; Kunio Shinkai, Handa; Kanehiro Ito, Aichi; Kazuo Yamada, Inazawa, all of Japan

[73] Assignee: Howa Kogyo Kabushiki Kaisha, Nagoya, Japan

[21] Appl. No.: 489,703

[22] Filed: Apr. 29, 1983

[51] Int. Cl.[3] ..... D01H 9/18

[52] U.S. Cl. ..... 57/276; 57/90; 57/266; 57/281

[58] Field of Search ..... 57/266–268, 57/274, 275, 276–278, 281, 90

[56] References Cited

U.S. PATENT DOCUMENTS

| | | | |
|---|---|---|---|
| 3,067,567 | 12/1962 | Baer | 57/276 X |
| 3,828,682 | 8/1974 | Klein | 57/281 X |
| 3,935,821 | 2/1976 | Maier et al. | 57/281 X |
| 3,946,547 | 3/1976 | Salmoiraghi | 57/281 X |

*Primary Examiner*—John Petrakes

*Attorney, Agent, or Firm*—McAulay, Fields, Fisher, Goldstein & Nissen

[57] ABSTRACT

A method and apparatus for switching the relative position between roving bobbins held by bobbin hangers of a front row and the roving bobbins held by the rear row in a spinning frame. The roving bobbin exchange operation is carried out as successive unit operations from one end-side of the spinning frame to the other end-side thereof. In each unit operation, first the axial distance between a bobbin hanger of the front row and a bobbin hanger of the rear row, which are positioned adjacently in the lengthwise direction of the spinning frame, is reduced to a predetermined distance, then the relative position of those two bobbin hangers is reversely changed while maintaining the reduced axial distance. Thereafter, the axial distance between those two bobbin hangers is returned to the initial condition for carrying out the spinning operation. The roving bobbin exchange operation can be carried out during the normal spinning operation, when the roving bobbins held by either one of the bobbin hangers of the front row and the rear row becomes substantially exhausted.

6 Claims, 28 Drawing Figures

METHOD AND APPARATUS FOR SWITCHING ROVING BOBBINS IN A SPINNING FRAME

BACKGROUND OF THE INVENTION

1. Field of the invention

The present invention relates to a method and apparatus for switching roving bobbins in a spinning frame. More specifically, the presnet invention relates to a roving bobbin exchange method and apparatus in a spinning frame in which two front and rear rows of bobbin hangers are arranged on a creel, roving bobbins are hung on the bobbin hangers of the two front and rear rows, and spinning is carried out by guiding rovings to a drafting zone from the roving bobbins.

2. Description of the Prior Art

Ordinarily, bobbins supplied from a roving process, which are to be mounted on a creel of a spinning frame, have a full bobbin diameter larger than the spindle pitch of the spining frame. Accordingly, roving bobbins are arranged in two rows in the longitudinal direction of the machine frame at an interval two times as long as the spindle pitch, and roving rods or roving guides are arranged between the front and rear rows of the bobbins to guide rovings from the roving bobbins. The roving bobbins are hung in the upper portion of the machine frame at the respective positions above the height of a worker. A recent tendency is to utilize a full bobbin having a very heavy weight exceeding 3 kg. Accordingly, in the roving bobbin exchange operation in the spinning frame, bobbins having a heavy weight must be lifted up to respective positions higher than the height of the worker, which operation is very troublesome. Furthermore, since several hundred (ordinarily about 400) full bobbins and the same number of empty bobbins must be handled for each spinning frame at each roving bobbin exchange operation, the roving bobbin exchange operation requires heavy labor.

Considerable research has been made foward the development of a method and apparatus for switching exhausted roving bobbins with full ones in a conventional spinning frame. For example, the invention disclosed in Japanese Examined Patent Publication No. 48(1973)-27209 provided a method of simultaneously exchanging a plurality of exhausted roving bobbins in a block with full ones utilizing a mechanical means. In this method, roving creels of the frame are divided into a plurality of blocks along the lengthwise direction of the spinning frame. The invention disclosed in Japanese Examined Patent Publication No. 54(1979)-3978 provided a semi-automatic method for exchanging exhausted roving bobbins with full ones, wherein roving creels are capable of displacement between their spinning and standby positions and wherein the roving bobbin exchange operation is manually carried out at the standby position.

The problem regarding the removal of exhausted bobbins from the bobbin hangers and mounting of full bobbins thereto can be solved by these prior arts. The operations of cutting rovings between bobbins held by the bobbin hangers and the corresponding draft parts, catching a free end portion of roving from each full bobbin held by the bobbin hangers, threading the free end portion of each roving into the draft parts of the spinning frame, piecing of yarn at the ring twisting and winding mechanism, etc., however, have to be manually effected.

Experience has shown that such manual operations are much more difficult for the bobbin hangers of the rear row than a front row. They have therefore sought to practically solve the problem due to the tworow arrangement of bobbin hangers.

SUMMARY OF THE INVENTION

It is the object of the present invention to provide a roving bobbin exchange method and apparatus in a spinning frame in which roving bobbins are held by bobbin hangers arranged along the longitudinal direction of the spinning frame in two parallel rows, whereby roving bobbins held by the bobbin hangers of the front row can be switched with roving bobbins held by bobbin hangers of the rear row and whereby the above-mentioned problem due to the two-row arrangement of bobbin hangers can be effectively solved.

According to the method and apparatus of the present invention, the troublesome exchange operation of exhausted bobbins by full ones can be carried out more easily compared with the known manual or automatic operation, because the bobbin exchange operation can be eliminated for the bobbins held by the bobbin hangers of the rear row. When applied to an automatic bobbin exchange operation, the invention enalbes an automatic bobbin exchange apparatus of a simpler construction than the known apparatus.

According to the method of the present invention, two rows of bobbin hangers are arranged along the longitudinal direction of the spinning frame so as to supply rovings to the draft parts from the bobbins held by the bobbin hangers. The spinning operation is commenced with half exhausted roving bobbins held by the bobbin hangers of either the rear row or front row and full roving bobbins held by the bobbin hangers of the other row. When halfexhausted roving bobbins become fully exhausted or become very small and almost exhausted, the full roving bobbins become half exhausted. At this time, the exhausted or very small bobbins are exchanged with full roving bobbins. Before or after this bobbin exchange operation, the relative position between the roving bobbins of the front row and the roving bobbins of the rear row, which supply a roving to the two adjacent draft parts, is switched without crossing the rovings, and the relative position between roving bobbins is stepwisely changed from one end of the row of spindles to the other end.

The basic apparatus for carrying out the method of the present invention is a roving supply device which supplies a roving to each one of two adjacent draft parts corresponding to the above-mentioned pair of bobbin hangers disposed above the draft parts. This device comprises a supporting mechanism capable of holding two roving bobbins in a hanging condition, a guide member for guiding two rovings from the roving bobbins to the corresponding draft parts respectively, a mechanism for turning the supporting mechanism 180° about a vertical axis which passes through a central point between the holding positions of the roving bobbins, and a mechanism for temporalily changing the distance between the axes of two bobbin hangers before and after the motion of the turning mechanism.

BRIEF DESCRIPTION OF THE DRAWINGS

FIG. 10A through FIG. 12D are drawings for explaining the operational function of the roving bobbin exchange apparatus according to the present invention, wherein FIGS. 10A through 10D are plan views of the switching mechanism of the apparatus, FIGS. 12A through 12D are partial sectional views of the main mechanism of the apparatus;

DESCRIPTION OF THE PREFERRED EMBODIMENTS

Figure 1:
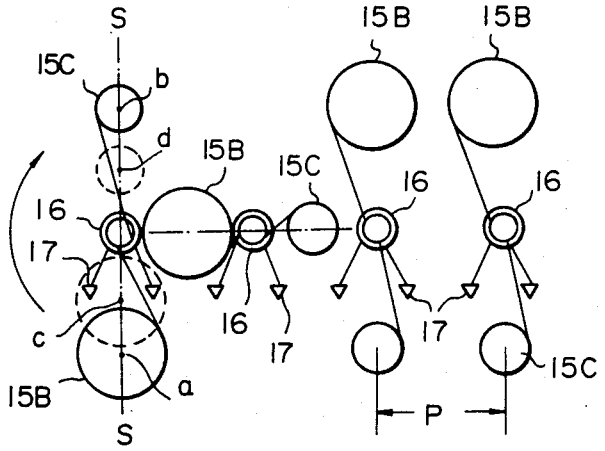
FIG. 1 is an explanatory drawing of the basic technical idea of the roving bobbin exchange method and apparatus according to the present invention.

Before explaining the method and apparatus for switching the relative positons between the roving bobbins of the front row and the roving bobbins of the rear row according to the present invention in detail with reference to embodiments, the basic technical idea of the present invention is hereinafter explained.

As described hereinbefore, in the method of switching the relative position between the bobbin hangers of the front row and the bobbin hangers of the rear row, half-exhausted bobbins are mounted on the bobbin hangers of either the front or rear rows and full bobbins are mounted on the bobbin hangers of the other row. The spinning operation is commenced in this state. Accordingly, the time when the bobbins of the front row become exhausted is different from the time when the bobbins of the rear row become exhausted. Accordingly, the roving bobbin exchange operation can be performed independently for the two rows. As pointed out hereinbefore, it is very difficult to perform the roving bobbin exchange operation for bobbins of the rear row which they are kept at the original inner side of the machine frame. In the present invention, in order to eliminate this disadvantage, the bobbins of the front row are switched with the bobbins of the rear row before or after the exhausted or half-exhausted bobbins are exchanged with full bobbins preliminarily prepared, for exchange of the exhausted or half-exhausted bobbins at any time. More specifically, when spinning is started with half-exhausted bobbins mounted on bobbin hangers of the rear row and full bobbins mounted on bobbin hangers of the front row, since the bobbins of the rear row first become exhausted, the roving bobbin exchange operation is carried out after the bobbins of the front row are repalced with the bobbins of the rear row. In contrast, when spinning is started with full bobbins mounted on bobbin hangers of the rear row and half-exhausted bobbins mounted on bobbins of the front row, the bobbins of the front row are switched with the bobbins of the rear row after the exhausted or small bobbins of the front row are exchanged with preliminarily prepared full bobbins.

As is apparent from the foregoing description, according to the present invention, spinning can be started whether full bobbins are mounted on the bobbin hangers of the front row or on bobbin hangers of the rear row. However, in the present invention, it is preferred that full bobbins be mounted on bobbin hangers of the front row and, when half-exhausted be switched with small bobbins of the rear row, because the switching of the relative positon between them can be performed in a narrow space very smoothly.

Regarding the timing of the operation for switching the relative position between the roving bobbins of the rear row and the roving bobbins of the front row, the operation may be effected at any time, so long as the diameter of the roving bobbins of the rear row and the diameter of the roving bobbins of the front row allow a troublefree 180° turning motion of the supporting mechanism for the bobbin hangers of the roving bobbin exchange apparatus.

The method for switching the relative position between the roving bobbins of the front row and the roving bobbins of the rear row under the above-mentioned basic condition is hereinafter explained in detail with reference to FIG. 1. In FIG. 1, each roving guide member 16 is disposed at a position between roving bobbin 15B held by a bobbing hanger of the front row and roving bobbin 15C held by a bobbin hanger of the rear row and the corresponding draft parts 17 in such a condition that the center of the roving guide is located at a symmetrical central position with regard to the above-mentioned two bobbin hangers and the corresponding two draft parts 17. Therefore, these roving guides 16 are aligned along the longitudinal direction of the spinning frame.

In FIG. 1, from the right, the first and second pairs of roving bobbins 15B and 15C are shown in the state after completion of the operation of switching the relative position of the bobbins. The third pair of roving bobbins 15B and 15C is shown in a 90° turning condition of the relative position. The fourth pair of roving bobbins 15B and 15C drawn by the solid lines shows the condition before the roving bobbin exchange operation. The pair drawn by the broken lines indicates the condition where the axial distance between the two roving bobbins 15B and 15C is reduced from the initial distance ab, which is the distance for carrying out the spinning operation, to the shortest distance cd, which is the distance for turning the mechanism for supporting the pair of bobbin hangers about the central axis of this supporting mechanism.

As shown in this explanatory drawing, the initial axial distance of the bobbin hangers is ab. First, the distance ab is reduced to cd by displacing the bobbin hangers. Second, the supporting mechanism of these bobbin hangers is turned 90° clockwise about the central axis thereof (toward the direction indicated by an arrow) so that the relative position of the roving bobbins 15B and 15C becomes that represented by the second pair of roving bobbins from the left. Third, the supporting mechanism is then further turned 90° clockwise about the central axis thereof. Finally, the axial distance between the above-mentioned two roving bobbins 15B and 15C is returned to the initial distance ab. Accordingly, the relative position between two roving bobbins 15B and 15C is switched from the initial condition to the reverse condition thereof.

As can be clearly understood from FIG. 1, since the roving guide 16 is provided with a guide surface sufficiently wide, the contact points of these two rovings with the guide surface of the roving guide 16 can be moved such that the two rovings from the roving bobbins 15B and 15C do not contact each other. Therefore, if the turning direction of the second step is alternated with each cycle of the roving bobbin exchange operation applied to each side arrangement of the spindles, crossing of the above-mentioned two rovings can be effectively prevented.

The apparatus for carrying out the above-mentioned method is hereinafter explained in detail with reference to the embodiment disclosed in FIG. 2 to FIG. 13. The apparatus disclosed is a roving bobbin exchange apparatus applied to a spinning frame provided with two rows of bobbin hangers at each side thereof, whereby the relative position between the roving bobbins of the front row and the roving bobbins of the rear row can be automatically switched.

Figure 2:
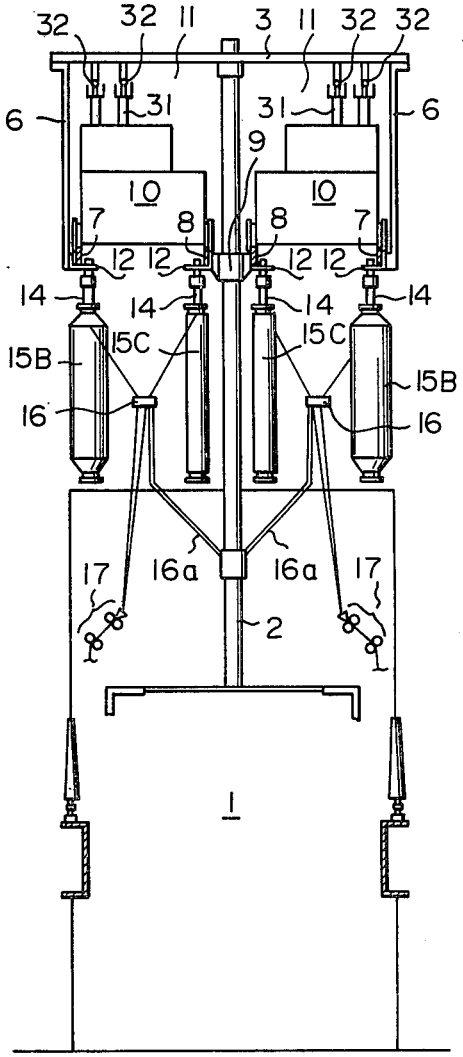
FIG. 2 is a schematic side view of a spinning frame provided with an apparatus for carrying out the method of the present invention, which shows the main portion of the spinning frame relative to the present invention, seen from the outend side of the spinning frame.

According to this embodiment, as shown in FIG. 2, in the central portion of a machine frame 1, a plurality of creel pillars 2 are arranged at appropriate intervals in the longitudinal direction of the machine frame. Two rails 7 and 8 are laid out and supported by the creel pillars 2 above draft parts 17 on both sides of the spinning frame. Two front and rear rows of bobbin hangers 14 are supported on the rails 7 and 8. The creel pillar 2 is extended upward more than an ordinary creel pillar. A spare rail bracket 3 extended on both sides in the lateral direction of the machine frame is secured to the upper portion of the creel pillar 2.

As shown in FIG. 2, a bracket 6 is attached to the spare rail bracket 3 at a position further inward than the position of the spare rail (not shown). A rail 7 of the front row extended in the longitudinal direction of the machine frame is secured to the lower end of the bracket 6. A rail 8 of the rear row is secured to a bracket 9 attached to the intermediate portion of the creel pillar 2. A space defined by the bracket 3, bracket 6, and creel pillar 2 above the rail 7 of the front row and the rail 8 of the rear row forms a passage 11 through which the roving bobbin exchange machine 10 can travel.

Figure 3:
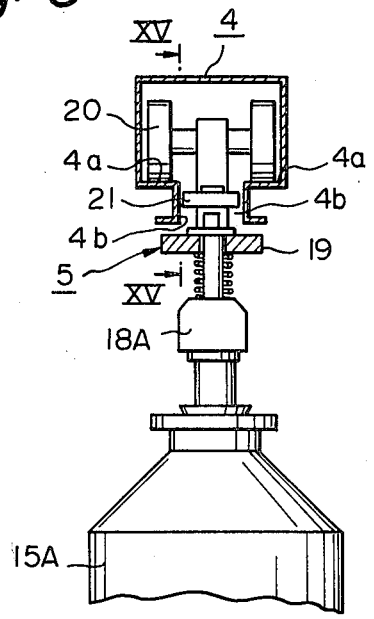
FIG. 3 is a partial sectional view of a spare rail portion of a creel of the spinning frame shown in FIG. 2.

As is seen from FIG. 3, the spare rail 4 has a hollow columnar shape having the lower portion thereof opened. Both the ends in the longitudinal direction of the spare rail 4 are opened. Bobbin carriages 5 having bobbin hangers 18 are inserted through these open ends.

Figure 4:
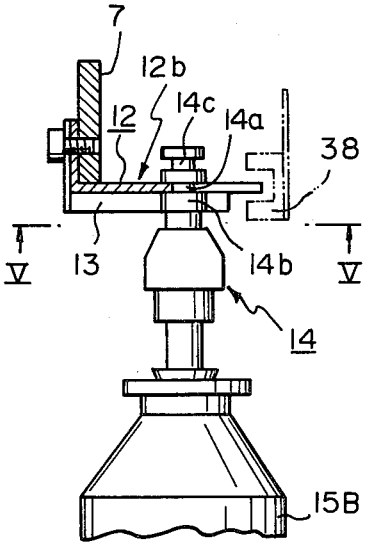
FIG. 4 is a partial sectional view of the front row of the creel for holding bobbin hangers of the spinning frame shown in FIG. 2.
Figure 5:
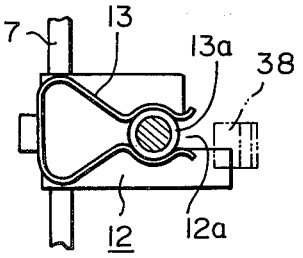
FIG. 5 is a sectional view of the bobbin creel taken along the line V—V in FIG. 4.

As shown in FIG. 4, bobbin hanger holders 12 and spring catches 13 are attached to the rail 7 of the front row and the rail 8 of the rear row at intervals P (see FIG. 1) two times as large as the spindle gauge of the spinning frame. The bobbin hanger holders 12 and spring catches 13 of the rail 7 of the front row are arranged to confront the corresponding bobbin hanger holders 12 and spring catches 13 of the rail 8 of the rear row. As shown in FIGS. 4 and 5, the spring catch 13 is disposed on the lower face of the bobbin hanger holder 12. The bobbin hanger holder 12 and spring catch 13 have an opening **12*a* and an opening 13*a*, respectively, engaged with each other. The opening 12*a* and 13*a* on the side of the rail of the front row confront theopenings of the bobbin hanger holder and spring catch on the side of the rail of the rear side. The opening 12*a* of the bobbin hanger holder 12 can be engaged with an engaging groove 14*a* formed on the top portion of the bobbin hanger 14. The opening 13*a* of the spring catch 13 can be resiliently engaged with a step 14*b* formed below the engaging groove 14*a* of the spring catch 13. Accordingly, if the top portion of the bobbin hanger 14 is inserted in both the openings 12*a* and 13*a*, the bobbin hanger 14 can be hung on the bobbin hanger holder 12 and spring catch 13 dismountably therefrom and maitained stably by a resilient force. Incidentally, there may be adopted a modification in which instead of utilizing the spring catch 13, a magnet, for example, a magnetized synthetic rubber, is disposed on the top face 12*b* of the bobbin hanger holder 12, and a magnetic member, such as an iron plate, is arranged on the bobbin hanger 14 in the portion contacted with the top face 12*b*, so that the bobbin hanger 14** is held firmly by magnetic force.

Another engaging groove **14*c* is formed on the top portion of the bobbin hanger 14 above the engaging groove 14*a* (See FIG. 4). When the bobbin hanger 14 is hung on the bobbin hanger holder 12, the engaging groove 14*c* is projected upward beyond the top face 12*b* of the bobbin hanger holder 12 and becomes engaged with grippers 52 and 53 (see FIGS. 8 and 9) of the roving bobbin replacing-machine 10**.

Referring to FIG. 2 again, the roving bobbins 15B and 15C first hung on the bobbin hangers 14 differ in diameter depending on whether they are in the front row or the rear row. For example, full bobbins are mounted on the bobbin hangers 14 of the front row and half-exhausted bobbins are mounted on the bobbin hangers 14 of the rear row.

Figure 6A:
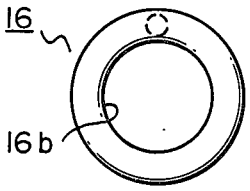
FIG. 6A and FIG. 6B are a plan view and a front view of a roving guide utilized for the spinning frame shown in FIG. 2, respectively.
Figure 7A:
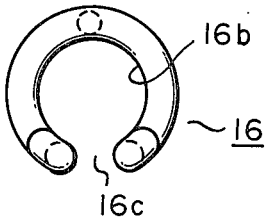
FIG. 7A and FIG. 7B are a plan view and a front view of another roving guide which can be utilized for the spinning frame shown in FIG. 2.
Figure 6B:
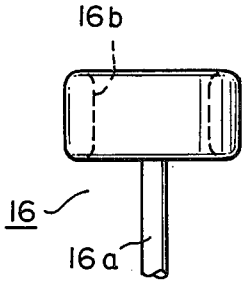
Figure 7B:
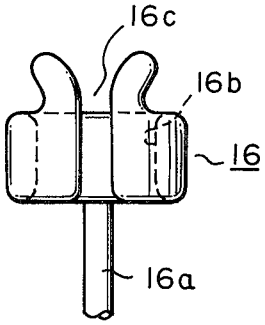

Roving guides 16 are disposed below the bobbin hangers 14 at a position intermediate between the hung bobbins of the front and rear rows. These roving guides 16 are attached to the creel pillar 2 through a supporting member **16*a*. FIGS. 6A and 6B show one embodiment of a roving guide 16. The roving guide of this embodiment has an annular shape and is provided with a roving guide hole 16*b*. FIGS. 7A and 7B shows another embodiment of the roving guide 16. The roving guide of this embodiment has a C-shape and is provided with a roving guide hole 16*b* and a roving guide groove 16*c*. Referring to FIG. 2, rovings taken out from the bobbins 15B and 15C of the front and rear rows are passed through the roving guide holes 16*b* of the roving guides 16 and are independently supplied to the draft parts 17**.

As shown in FIG. 2, the two roving bobbin switching machines 10 running along the rails 7 and 8 of the front and rear rows on both sides of the spinning frame, respectively, are bisymmetrical with each other and have the same structure. Accordingly, only one roving bobbin exchange machine (left machine in FIG. 2) will be described with reference to FIGS. 8 and 9.

Left and right driving wheels 27 and driven wheels 28 are attached to a body 29 of the roving bobbin exchange machine 10. The driving wheel 27 is secured to a wheel shaft 36. A gear 37 built in the body 29 is similarly secured to the wheel shaft 36. The gear 37 is engaged with a gear 35 secured to an output shaft 34 of a brake-provided driving motor 33 arranged within the body 29. The left and right driving wheels 27 and driven wheels 28 are turnably arranged on the front row rail 7 and rear row rail 8 of the spinning frame 1. Namely, the body 29 of the roving bobbin switching machine 10 is movably placed on the front row rail 7 and rear row rail 8. A control box 30 is mounted on the top face of the body 29, and two collectors 31 are projected above the control box 30. When the roving bobbin exchange machine 10 is placed on the front row rail and rear row rail 8 of the spinning frame 1, the collectors 31 fall in contact with trolley lines 32 laid out above the creel to supply electricity to the roving bobbin exchange machine 10.

The driving motor 33 can rotate in either the normal or reverse direction. By rotation of the motor 33, the driving wheel 27 is driven through the gears 35 and 37 to move the roving bobbin exchange machine 10 reciprocatively on the front row rail 7 and rear row rail 8. A photoelectric stop position detector 38 is arranged in the roving bobbin exchange machine 10. Every time the detector 38 detects a detecting piece 39 or bobbin hanger holder 12 during the travel of the roving bobbin exchange machine 10, it generates a detection signal. The driving motor 33 is suddenly stopped by instructions of this signal and the roving bobbin exchange machine 10 is reliably stopped at a predetermined position.

A vertical main shaft 41 is turnably fitted in a boss portion 40*a* of a bracket 40 secured to the inner wall of the body 29. A clutch 42 is slidably key-connected to the intermediate portion of the main shaft 41. One end of a shift lever 43 is engaged with this clutch 42. The shift lever 43 is normally urged by a spring 44 to raises up the clutch 42. The other end of the shift lever 43 is connected to a clutch changeover solenoid 45. When the solenoid 45 is excited, the shift lever 43 slides the clutch 42 downward. If the clutch 42 is raised up, an upper tooth 42*a* of the clutch 42 is engaged with a tooth 40*b* formed on the lower end of a boss portion 40*a* of the bracket 40 to control the rotation of the main shaft 41. If the clutch 42 is slid downward by the excitation of the solenoid 45, a lower tooth 42*b* of the clutch 42 is engaged with a clutch tooth 48 formed integrally on the top face of a gear 47.

A groove cam 46 is rotatably fitted on the main shaft 41. Two cam grooves 46*a* and 46*b* are formed on the lower face of the groove cam 46. The above-mentioned gear 47 and clutch tooth 48 are integrally connected to the upper side of the groove cam 46. The gear 47 mounted on the body 29 is engaged with a gear 50 attached to an output shaft of a driving motor 49 capable of rotating in both the normal and reverse directions. Accordingly, when the motor 49 is rotated, the groove cam is driven through the gear 50 and gear 47 to rotate in the horizontal plane.

As shown in FIG. 11A to 11D, the two cam grooves 46*a* and 46*b* have similar gourd-like shapes and are arranged concentrically with each other. Cam followers 51 formed on the tops of two pairs of grippers 52 and 53 are engaged with the cam grooves 46*a* and 46*b*. The grippers 52 and 53 are slidably fitted in two guide rods 54*a* and 54*b* (see FIG. 10) held on a grip holder 54 key-secured to the main shaft 41, respectively. Claws 52*a* and 53*a* are formed on the lower ends of the left and right grippers 52 and 53. These claws 52*a* and 53*a* can be engaged with engaging grooves 14*c* formed on the tops of the front row and rear row bobbin hangers 14, respectively.

As shown in FIG. 11A to 11D, the two cam grooves 46*a* and 46*b* shorten or lengthen the distance between the cam followers 51 of the grippers 52 and 53 of each pair engaged with the cam grooves 46*a* and 46*b* to bring the bobbin hangers of the front and rear rows close to each other or separate them from each other. Thus, the grippers 52 and 53 of each pair hold the bobbin hangers 14 of the front and rear rows, bring them close to each other, or separate them from each other and release them. More specifically, if the groove cam 46 is rotated in the state where the main shaft 41 is kept stationary, since the cam follower 51 is engaged with the inner cam groove 46, the gripper 52 slides along the guide rods 54*a* and 54*b* according to the shape of the inner cam groove 46*a*. Similarly, the other gripper 53 slides along the guide rods 54*a* and 54*b* along the shape of the outer cam groove 46*b*.

It is in the case where the upper tooth 42*a* of the clutch 42 is engaged with the tooth 40*b* formed on the boss portion 40*a*, that is, in the case where the solenoid 45 is not excited, that the main shaft 41 is kept stationary and only the groove cam 46 is rotated. In contrast, in the case where the solenoid 45 is excited, the lower tooth 42*b* of the clutch 42 is engaged with the clutch tooth 48. Since the clutch 42 is key-connected to the main shaft 41, if the gear 47 is rotated, the groove cam 46 and main shaft 41 are synchronously rotated. Since the guide rods 54*a* and 54*b* are rotated together with the main shaft 41, no relative movement is caused between the groove cam 46 and the grippers 52 and 53.

Figure 8:
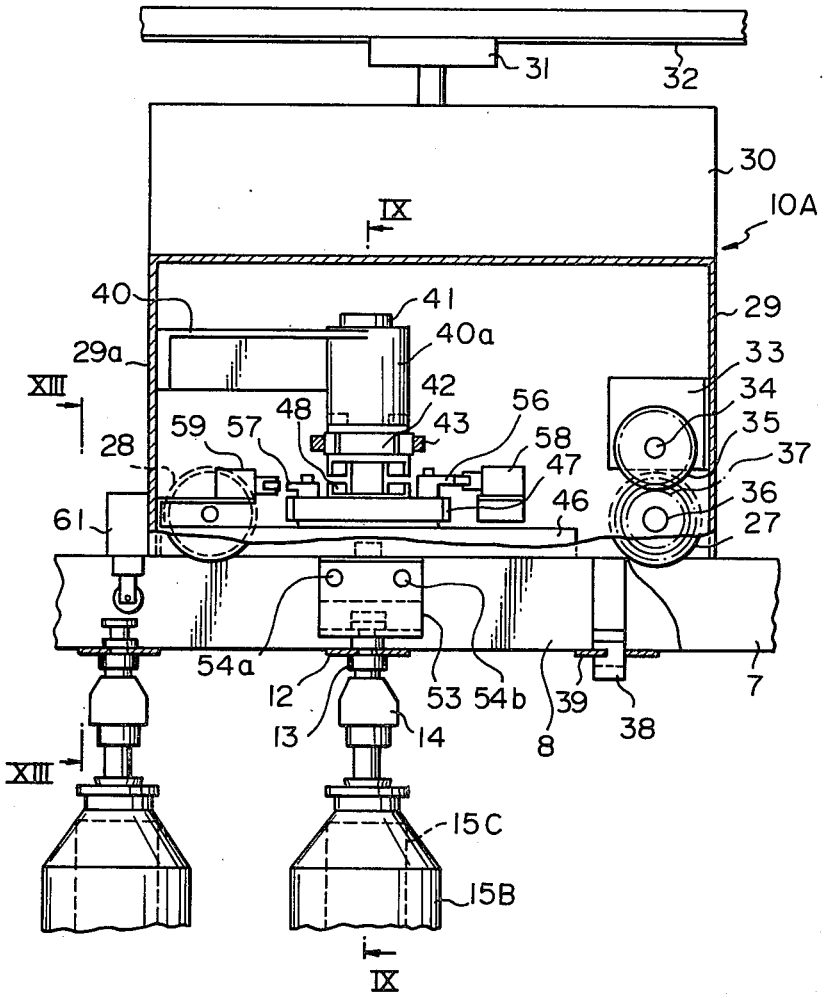
FIG. 8 is a partially cutoff sectional view of the roving bobbin exchange apparatus according to the present invention, which is taken along the line VIII—VIII in FIG. 9.
Figure 9:
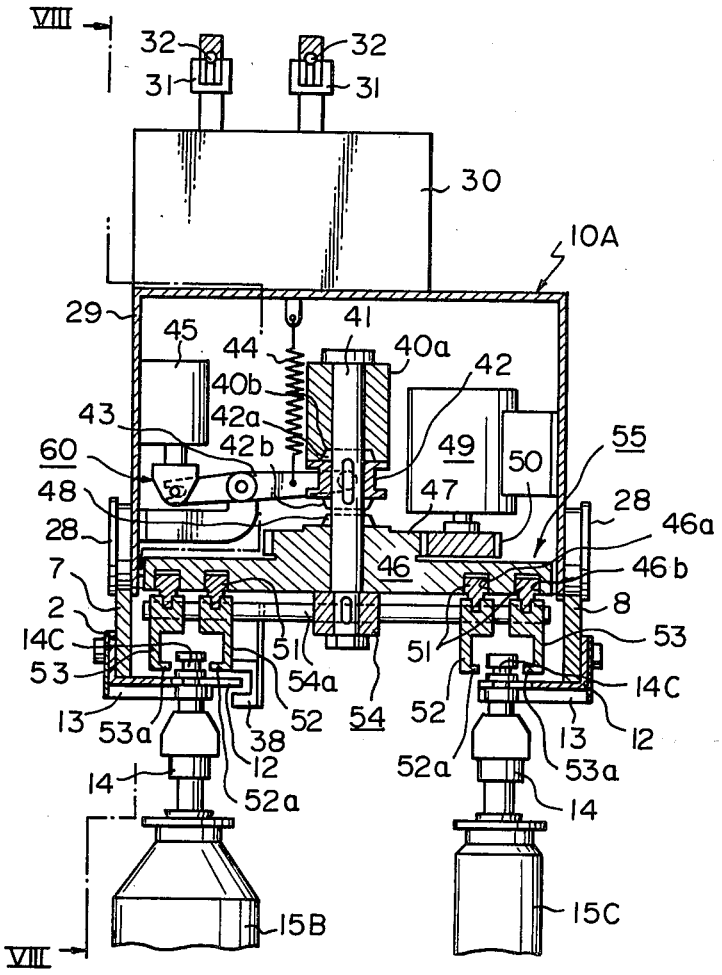
FIG. 9 is a sectional view of the roving bobbin exchange apparatus according to the present invention, taken along line IX—IX in FIG. 8.
Figure 10A:
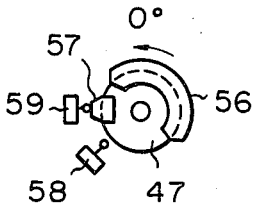

Changeover of the above-mentioned clutch 42 is controlled by a plurality of switches. As shown in FIG. 8 and FIG. 10A, a changeover switch dog 56 and an operaton completion detecting switch dog 57 are secured to the top face of the gear 47 connected to the groove cam 46. Limit switches 58 and 59 corresponding to the switch dogs 56 and 57 are arranged at outer fixed positions. By instructions of these limit switches 58 and 59, the clutch changeover solenoid 45 is actuated. An electric connection is made so that when the operation completion detecting limit switch 59 is actuated, the driving motor 33 is started again.

FIGS. 10A, 10B, 10C, and 10D show relations between the switch dogs 56 and 57 and the limit switches 58 and 59. FIGS. 11A, 11B, 11C, and 11D show the rotation states of the groove cam 46. FIGS. 12A, 12B, 12C, and 12D show relations between the grippers 52 and 53 and the clutch 42.

Figure 10B:
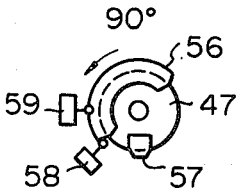
Figure 11A:
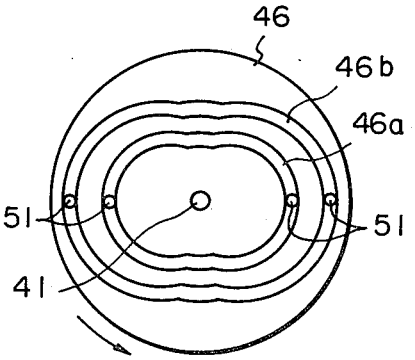
FIG. 11A through 11D are plan views of the cam mechanism thereof.
Figure 11B:
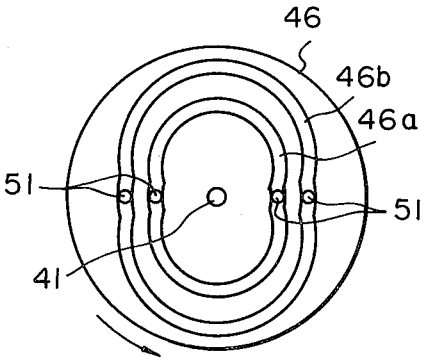
Figure 12A:
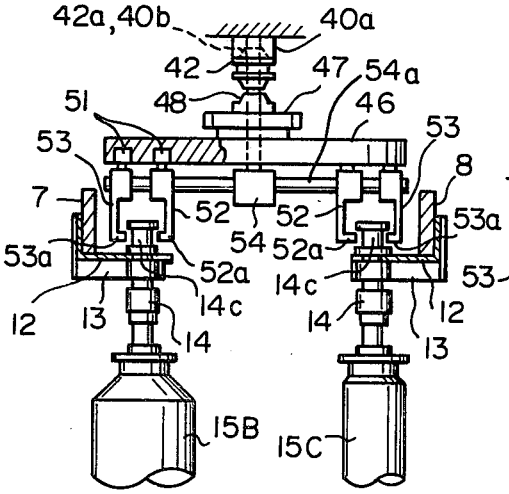
Figure 12B:
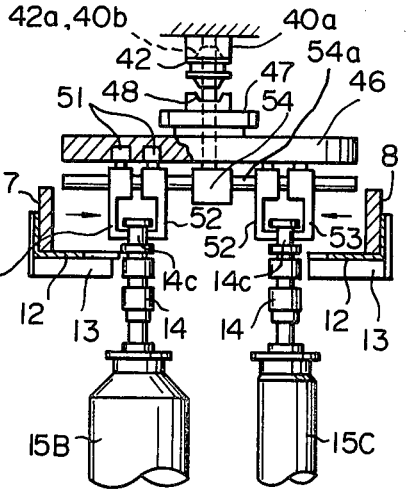

At the first position, that is, the starting position shown in FIG. 12A, the grippers 52 and 53 of each pair are in the open state, and the claws 52*a* and 53*a* of the grippers 52 and 53 are not engaged with the bobbin hangers 14. The bobbin hangers 14 are hung by the bobbin hanger holders 12 and spring catches 13 attached to the front row rail 7 and rear row rail 8, respectively. At the starting position, the operation completion detecting switch dog 57 confronts the operation completion detecting limit switch 59 as shown in FIG. 10A, and the rotation of the gear 47 and groove cam 46 is continued until the motor 49 beings to rotate and the operation completion detecting switch dog 57 actuates the operation completion detecting limit switch 59 again. Namely, when the groove cam 46 rotates by 360°, it stops. The state of the second postion of 90° rotation from the start position is illustrated in FIGS. 10B, 11B, and 12B. While the groove cam 46 is rotated from the starting position to the second position, the grippers 52 and 53 of each pair are brought close to each other and slide to the center of the groove cam 46 along the guide rods 54*a* and 54*b*. Thus, as shown in FIG. 12B, the bobbin hangers 4 of the front and rear rows are tightly held by the claws 52*a* and 53*a* of the grippers 52 and 53 of each pair, drawn out from the openings 12*a* and 13*a* of the bobbin hanger holder 12 and spring catch 13, and the bobbin hanger 14 of the front row is brought close to the bobbin hanger 14 of the rear row. At the second position, the changeover switch dog 56 falls in contact with the limit switch 58, with the result that the solenoid 45 is excited and the lower tooth 42*b* of the clutch 42 becomes engaged with the clutch tooth 48 [FIG. 12B shows the state just before the changeover].

Figure 10C:
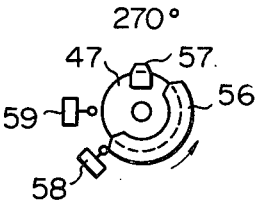
Figure 11C:
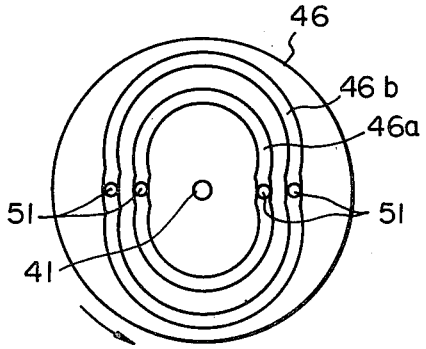
Figure 12C:
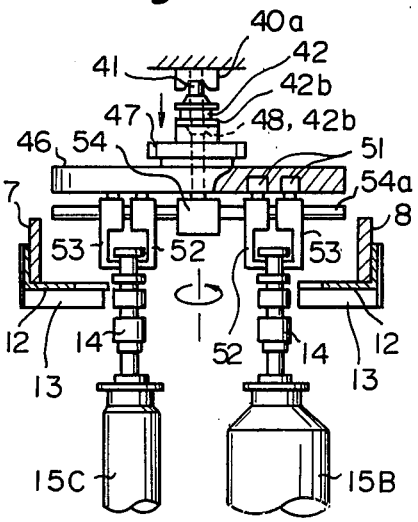

The state of the third position of 270° rotation from the start position is shown in FIGS. 10C, 11C and 12C. Since the switch dog 56 is kept in contact with the limit switch 58 during the rotation of 180° from the second position to the third position, the solenoid 45 is kept excited and, therefore, the lower tooth 42*b* of the clutch 42 is kept engaged with the clutch tooth 48. During this rotation of 180°, the main shaft 41 and the gripper holder 54 are rotated together with the groove cam 46, with the result that the bobbin-hanging bobbin hangers 14 of the front and rear rows are exchanged with each other. FIG. 12C shows the state of this switch. At the time of the switch, as in case of the second position, two pairs of the grippers are gathered to the center in a state close to each other and the replacement is effected in this state. Accordingly, the switch of bobbins can be accomplished even in a narrow space and contacting of adjacent bobbins with each other is prevented.

Figure 10D:
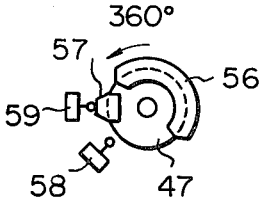
Figure 11D:
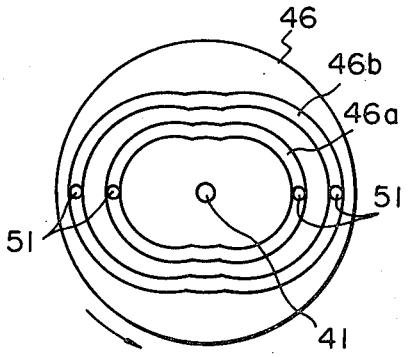
Figure 12D:
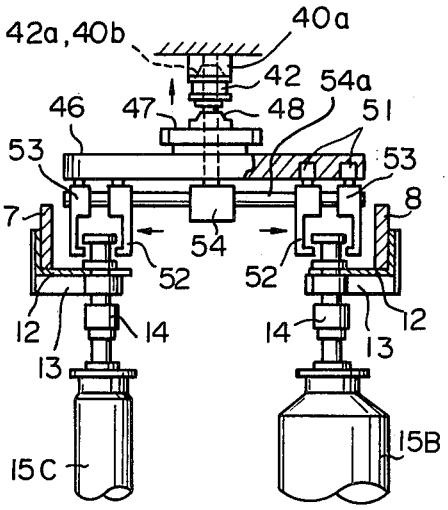

The state of the fourth position of 360° rotation from the starting position is illustrated in FIGS. 10D, 11D, and 12D. During the rotation from the third position to the fourth position, the switch dog 56 is not contacted with the limit switch 58 and, therefore, the solenoid 45 is de-energized, the clutch 42 is raised up again, and the upper tooth 42*a* of the clutch 42 is engaged with the tooth 40*b* of the boss portion 40*a*. Accordingly, the main shaft 41 is kept stationary while the groove cam 46 is rotated from the third position to the fourth position. Therefore, the grippers 52 and 53 are slid along the guide rods 54*a* and 54*b* according to the shapes of the cam grooves 46*a* and 46*b*. In this case, contrary to the case of the movement from the first position to the second position, the distance between the paired grippers 52 and 53 is gradually increased, and the grippers 52 and 53 are moved outward so that they separate from each other. As a result, the bobbin hangers 14 which have been held by the grippers 52 and 53 are inserted into the openings 12*a* and 13*a* of the hanger holder 12 and spring catch 13 and are held by them. Simultaneously, the claws 52*a* and 53*a* of the grippers 52 and 53 separate from the engaging grooves 14*c* formed on the tops of the bobbin hangers 14 to release the bobbin hangers 14. Since the switch dog 57 falls in contact with the operation completion detecting limit switch 59, the rotation of the motor 49 is stopped and the driving motor 33 is started again.

As described hereinbefore, the bobbin hangers 14 of the front row are switched with the bobbin hangers 14 of the rear row. This replacement is accomplished mainly by the two mechanisms, that is, the mechanism of attaching the bobbin hangers 14 to the bobbin hanger holder 12 and spring catch 13 and dismounting the bobbin hangers 14 therefrom and the mechanism for turning the bobbin hangers 14 by 180°. In the above-mentioned embodiment, the attachment and dismounting of the bobbin hangers 14 are accomplished by the cooperation of two cam grooves 46*a* and 46*b*, two pairs of grippers 52 and 53 having cam followers 51 to be engaged with these cam grooves, and the guide rod 54*a* slidably supporting the grippers. In other words, the bobbin hanger attaching and dismounting mechanism 55 is constructed by the above-mentioned elements. The grippers 52 and 53 are turned by the cooperation of the clutch tooth 48 integrally connected to the groove cam 46, the clutch 42 engaged with the clutch tooth, the main shaft key-connected to the clutch 42, and the gripper holder 54 key-secured to the main shaft 41. The turning mechanism 60 is constructed by these elements.

Figure 13:
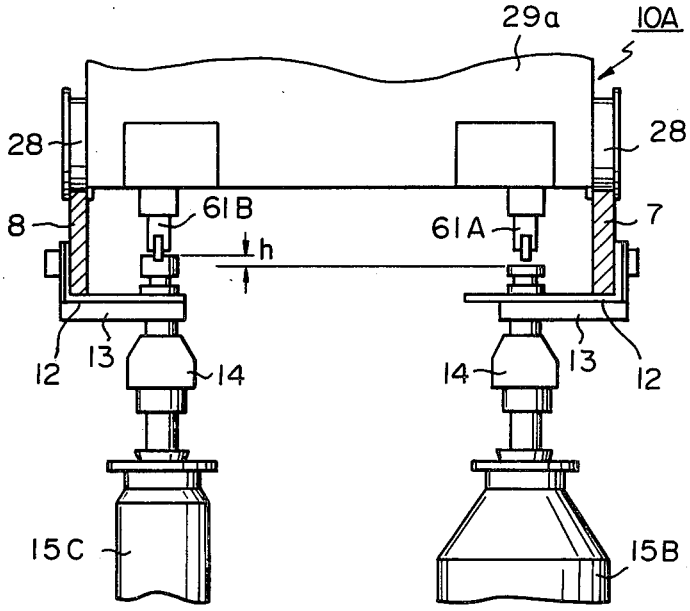
FIG. 13 is a sectional view of a part of the roving bobbin exchange apparatus according to the present invention.

As hereinbefore explained, in the case where the bobbin hangers 14 of the front row are switched with the bobbin hangers 14 of the rear row by the roving bobbin exchange machine 10, if the bobbin hangers 14 are turned in the same direction as that of the preceding bobbin exchange, that is, if the bobbin hangers are turned two times in the same direction by 180° each time, two rovings continuous from the roving bobbins of the front and rear rows to the drafting zone 17 would entangle with each other. If spinning is continued in this state, breakage of the rovings would be caused. This undesirable phenomenon can be prevented if the turning direction of the bobbin hangers is reversed at every roving bobbin exchange. The following arrangement is adopted for this purpose. As shown in FIGS. 8 and 13, limit switches 61A and 61B indicating the turning direction of the grippers are arranged on the front face 29*a* (the end face in the advancing direction) of the body 29 of the roving bobbin exchange machine 10 to confront the bobbin hangers 14 of the front and rear rows located below. The height of the top portion of one (left bobbin hanger in FIG. 13) of the pair of the front row and rear row bobbin hangers 14 on the entry side end of the roving bobbin switching machine is made slightly larger than the height of the top portion of the other bobbin hanger 14 (the height difference between the two bobbin hangers is indicated by h in FIG. 13). The limit switch 61A or 61B located above is actuated by the higher top portion of the bobbin hanger. Accordingly, at every roving bobbin exchange, the position of the bobbin hanger having the higher top portion is changed between the front and rear rows. Therefore, the limit switches 61A and 61B are actuated alternately when the roving bobbins are switched. By instructions of the limit switch 61A or 61B, the motor 49 driving the gear 47 of the groove cam 46 is rotated in the normal or reverse direction, with the result that the turning direction of the turning mechanism 60 is reversed. In the case where rovings are supplied from roving bobbins 15 of the front and rear rows to the drafting zones 17 located on both the left and right sides of the imaginary plane S—S connecting the axes of the bobbins of the front and rear rows as shown in FIG. 1, each of the roving bobbins is alternately turned by 180° in the normal or reverse direction on the side where the drafting zone to which the roving taken out from the roving bobbin is supplied is located, that is, on the right or left side of the imaginary plane S—S. In the embodiment illustrated in FIG. 1, the half-exhausted bobbin 15B of the front row is passed on the left side of the roving guide 16 and the exhausted bobbin 15C of the rear row is passed on the right side of the roving guide 16, and both the bobbins are switched with each other.

Upon completion of the roving bobbin exchange operation by the above-mentioned apparatus, the exhausted bobbins held by the bobbin hangers are taken out therefrom and full roving bobbins are mounted instead. The bobbin exchange operation can be carried out manually, however, a very practical bobbin exchange apparatus has been developed which can be effectively utilized for the spinning frame shown in FIG. 14, which also utilize the roving bobbin exchange apparatus. The construction and the function of this automatic bobbin exchange apparatus is disclosed in Japanese Patent Applicaton No. 56-175757, filed by the identical inventors and applicant as this application.

Figure 14:
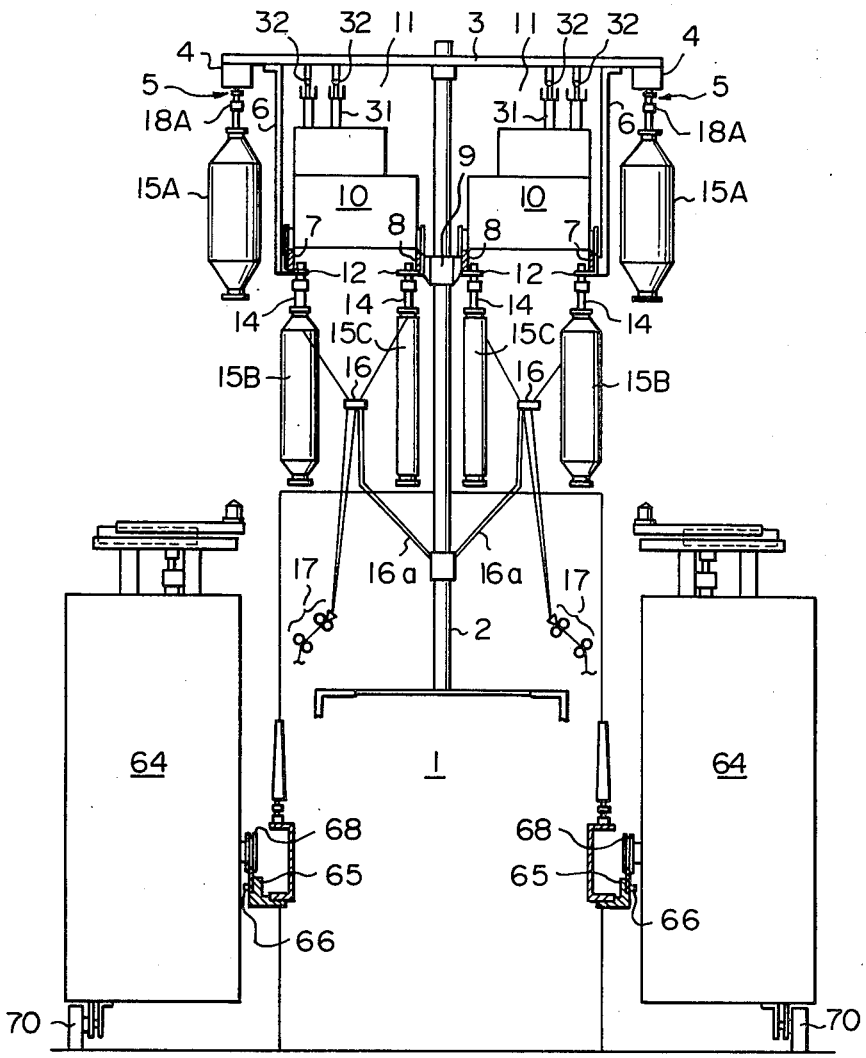
FIG. 14 is a schematic side view of a spinning frame provided with a roving bobbin exchange apparatus according to the present invention and a known apparatus for exchanging roving bobbins, which shows the main portion of the spinning frame relative to the present invention seen from the outend side of the frame.

The spinning frame disclosed in FIG. 14 utilizes the roving bobbin exchange apparatus of the present invention and the above-mentioned bobbin exchange apparatus. Since the construction and function of the component mechanisms of this spinning frame are quite similar to those of the spinning frame shown in FIG. 2 except for members related to the bobbin exchange apparatus, only different portions are explained.

As shown in FIG. 4, the top ends of the spare rail bracket 3 are projected to the upper portion of the passage on the front of the spinning frame. Spare rails 4 extended along the entire length of the machine frame are attached to both end portions of the brackets 3, respectively.

Figure 15:
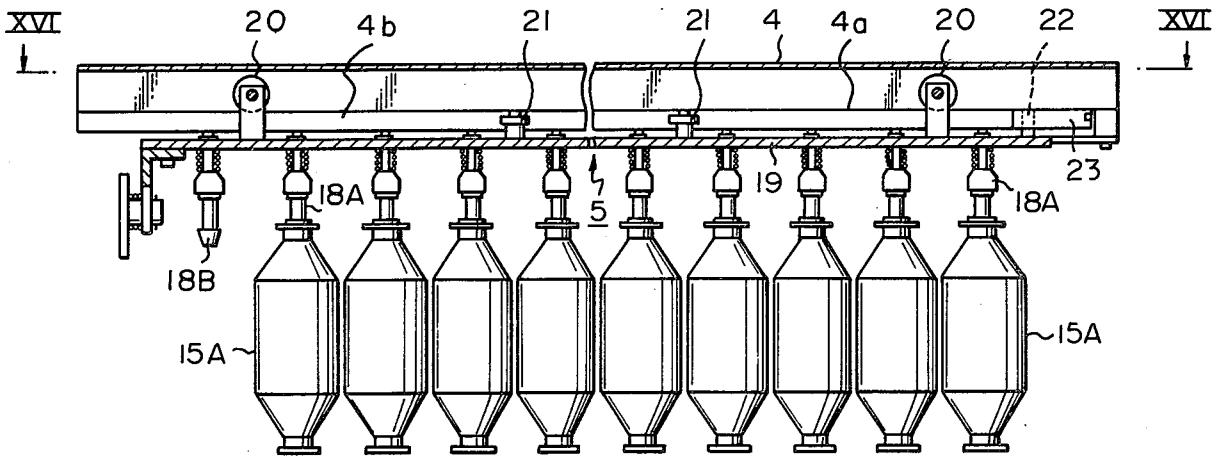
FIG. 15 is a sectional view of the spare rail portion of the creel taken along the line XV—XV in FIG. 3.
Figure 16:
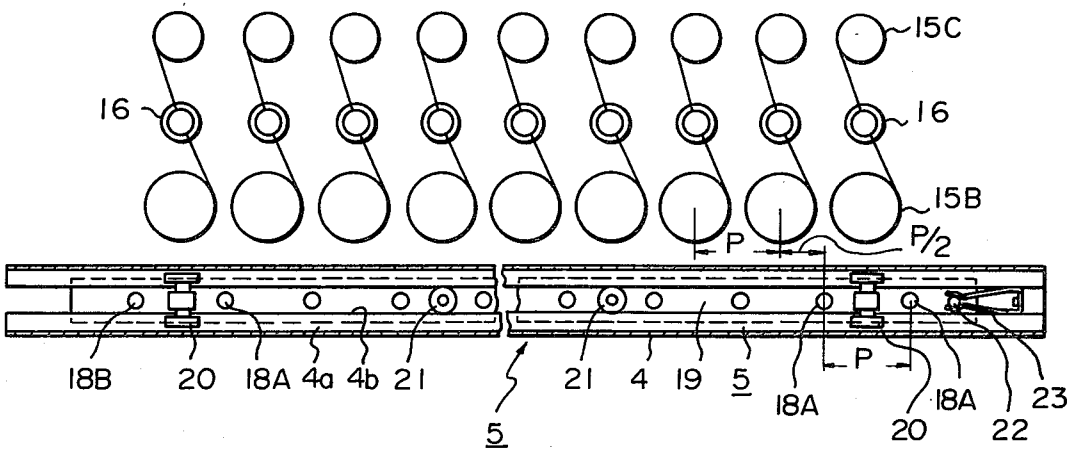
FIG. 16 is a partial sectional view of the spare rail portion of the creel taken along the line XVI—XVI in FIG. 15.

Movable bobbin carriages 5 provided with a bobbin hanger 18 are mounted on the spare rails 4 arranged on both the sides of the creel pillar. As shown in FIGS. 15 and 16, in the bobbin carriage 5, bobbin hangers 18A for one creel and one or several spare bobbin hangers 18B for the roving bobbin exchange are attached to a bobbin carriage bar 19 at the same intervals as the bobbin intervals P in the creel. A vertical guide roller 20, a horizontal guide roller 21, and a stop pin 22 are arranged on the top face of the bobbin carriage bar 19. As shown in FIG. 3, the vertical roller 20 can be placed on the horizontal face 4*a* of the spare rail 4 so that the roller 20 can roll thereon. The horizontal guide roller 21 can be engaged with the vertical face 4*b* of the spare rail 4. As shown in FIGS. 15 and 16, the stop pin 22 is attached to one end of the bobbin carriage bar 19. When the bobbin carriage 5 is inserted in the spare rail 4, the stop pin 22 is inserted in a spring catch 23 attached to one end of the spare rail 4 and is elastically held. By this arrangement, the bobbin carriage bar 19, that is, the bobbin carriage, is positioned. In this positioned state, as shown in FIG. 16, the position of the bobbin hanger 18A is deviated by ½ pitch (P/2) from the position of the creel bobbin.

A full bobbins 15A should be hung on the bobbin hanger 18A of the bobbin carriage before the start of the roving bobbin exchange. This can be accomplished by two methods. According to one method, in the state where the bobbin hanger 18A is kept empty, the bobbin carriage 5 is hung on the spare rail 4. Then, a full bobbin 15A is attached to the bobbin hanger 18A. According to the other method, before the bobbin carriage 5 is hung on the spare rail 4, a full bobbin 18A is hung on the bobbin hanger 18A, and the bobbin carriage 5 is inserted in the spare rail 4 by appropriate transporting means. In each method, on the bobbin hanger 18B for the roving bobbin exchange, which is arranged on one end of the bobbin carriage bar 19, a full bobbin 15A is not hung, but the bobbin hanger 18B is kept empty.

Figure 17:
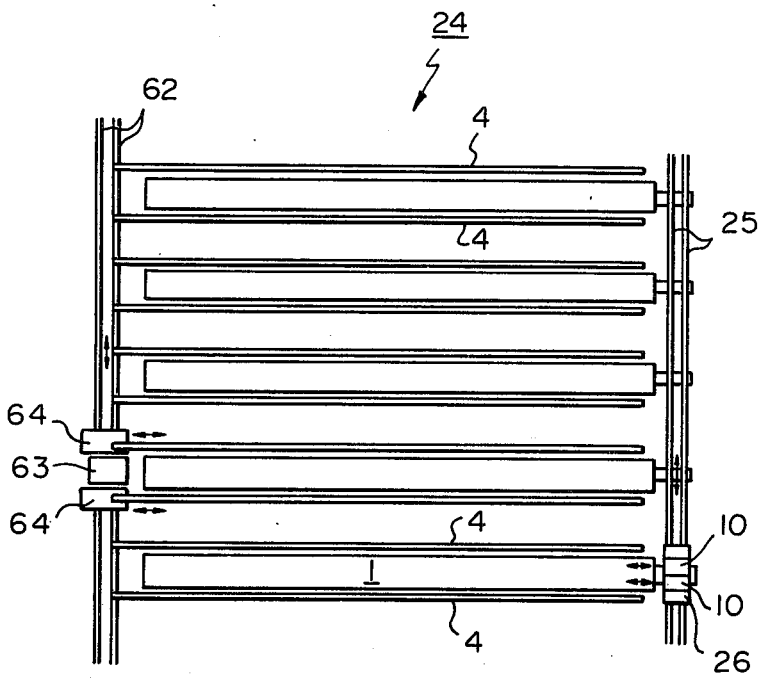
FIG. 17 is a plan view of the arrangement of the spinning frames, roving bobbin exchange apparatus according to the present invention, and a known roving bobbin exchange apparatus.

A predetermined number of spinning frames 1 having the above-mentioned creel arrangement are arranged in parallel with a passage of an appropriate width being formed between every two adjacent frames to construct a spinning frame assembly 24, as shown in FIG. 17. Two rails 25 for a transporting truck 26 for the roving bobbin exchange machine are laid out above the end portions of the machine stands on the outside end (right side in FIG. 17) of the spinning frame assembly 24. The transporting truck 26 has two right and left symmetric roving bobbin exchange machines 10 loaded thereon so that the exchange of the bobbins of the front row with the bobbins of the rear row can be performed simultaneously on both the sides of the spinning frame. The transporting truck 26 makes a reciprocative movement on the rails 25 and connects the roving bobbin exchange machines 10 to the outside end portions of the rails 7 and 8 of the front and rear rows on both sides of the spinning frame 1.

The operation of the roving bobbin exchange apparatus according to the present invention, which is utilized for the spinning frame shown in FIG. 14, is hereinafter explained in the relation with the automatic bobbin exchange apparatus mentioned above.

During the operation of the spinning frame 1, prior to the roving bobbin exchange, the bobbin carriages having full bobbins of one row of the creel hung on the bobbin hanger 18A are inserted in the spare rails 4 on both the sides of the creel through appropriate transporting means. As shown in FIGS. 15 and 16, the positioning is performed so that each full bobbin is located at a position (P/2) intermediate between two adjacent bobbins of the front row. The transporting truck 26 for the roving bobbin exchange machine is connected to the outside end of the spinning frame 1 to which the above-mentioned spare bobbins have been supplied. Then, as shown in FIG. 14, at the point when the bobbins of the rear row become small and the bobbins of the front row become half-exhausted, the left and right roving bobbin exchange machines 10 loaded on the truck are shifted onto the rails 7 and 8 of the front and rear rows on both the sides of the creel and are forwarded from the outside end to the gear side end in the left and right passages 11.

When a roving bobbin exchange machine 10 is forwarded from the outside end and the limit switches 61A and 61B attached to the front face of the body 29 arrive at a position above the first bobbin hanger 14 on the entry side, as shown in FIG. 13, one limit switch is actuated by engagement with the top of the bobbin hanger 14 located below to electrically store the turning direction of the turning mechanism 60. When the roving bobbin exchange machine 10 is further advanced and the stop position detector 38 detects the detecting piece 39 arranged before the bobbin hanger 14, as shown in FIG. 8, the driving motor 33 is stopped by the instruction of the detector 38, and the roving bobbin exchange machine 10 is stopped at the first bobbin exchange position where the pair of the left and right grippers 52 and 53 of the attaching and dismounting mechanism 55 confront the first bobbin hangers 14 of the front and rear rows (see FIGS. 8 and 9). When the roving bobbin exchange machine is stopped by the detection signal of the stop position detector 38, the motor 49 for driving the attaching and dismounting mechanism 55 is actuated. As described hereinbefore with reference to FIGS. 10A to 12D, by the cooperation of the attaching and dismounting mechanism and the turning mechanism, the half-exhausted bobbins of the front row are switched with the small bobbins of the rear row while the groove cam 46 makes one rotation, and the bobbin hanger 14 hanging the medium bobbins thereon is supported by the bobbin hanger holder 12 and spring catch 13 of the rear row, while the bobbin hanger 14 hanging the small bobbins thereon is supported by the bobbin hanger holder 12 and bobbin catch 13 of the front row. Even if this exchange of the bobbins of the front and rear rows is carried out in the state where two rovings from the bobbins of the front and rear rows are passed through the roving guide 16 located at a position intermediate between both the bobbins and the roving are supplied to the drafting zones 17, as described hereinbefore with reference to FIG. 1, entanglement of the rovings is prevented and breakage of the rovings is not caused. Accordingly, the switch of the bobbins of the front and rear rows by the roving bobbin exchange machine 10 can be performed either during the operation of the spinning frame 1 or while the spinning frame 1 is stopped. If the roving bobbin exchange operation is carried out during the operation of the spinning frame 1, the time for the stoppage of the spinning frame for the bobbin exchange can be shortened.

When the groove cam 46 makes one rotation, the limit switch 59 is actuated by the switch dog 57. By the instruction of the limit switch 59, the driving motor 49 is stopped, and the driving motor 33 is started again, whereby the left and right roving bobbin exchange machines 10 are moved to the next bobbin exchange positions. As shown in FIG. 5, every time the stop position detector 38 detects the bobbin hanger holder 12 of the bobbin hanger 14 of the rear row which has been exchanged, the roving bobbin exchange machine 10 is stopped at the next roving bobbin exchange position and the half-exhausted bobbin of the front row is exchanged with the small bobbin of the rear row. During the course from the outside end to the gear side end, the roving bobbin exchange machines perform exchange of bobbins of the front and rear rows for two spindles in succession. After completion of exchange of bobbins for one creel, the exchange machines travel in the reverse direction and returned onto the transporting truck 26 atanding by on the outside end.

When exchange of medium bobbins with small bobbins on both the sides of the creel is thus completed and the left and right roving bobbin exchange machines are returned onto the transporting truck, the transporting truck 63 is connected to the gear side end of the spinning frame 1 at an appropriate timing. The left and right roving bobbin exchangers 64 loaded on the truck 63 are forwarded from the gear side end toward the outside end, and exchange of exhausted bobbins 15C of the front row with spare full bobbins 15A is performed in succession from the gear side end to the outside end. The exhausted bobbins 15C shifted from the bobbin hanger 14 of the front row of the creel to the bobbin hanger 18A of the spare rail 4 are actually half-exhausted bobbins 15C on which small quantities of rovings are left. Rovings being spun are cut by this exchange. The bobbins hung on the spare rail are those with still a very small quantity of roving remaining.

Before the cut end of the roving of the side of the draft part 17 is introduced to the trumpet of the draft part 17, an operator catches a free end portion of the roving of the full bobbin and threads this free end into the trumpet so as to prevent possible breakage of the yarn downstream after the draft part 17. Such a piecing operation of the fresh roving with the cut end of the roving is stepwisely carried out from one end of the spinning frame to the other end along the spindle arrangement.

The left and right roving bobbin exchangers 64 which have completed exchange of bobbins for one creel travel in the reverse direction on completion of of piecing of the rovings and are returned onto the transporting truck 63.

In the above-mentioned embodiment, full bobbins 15A hung on the spare rail 4 are supplied before exchange of bobbins of the front and rear rows. However, it is sufficient if the supply of full bobbins 15A is performed before the completion of exchange of the bobbins of the front and rear rows. Furthermore, in the foregoing embodiment, exchange of the bobbins of the front row with full bobbins is started after the completion of exchange of the bobbins of the front rear rows for all the spindles. There may, however, be adopted a modification in which the roving bobbin exchanger 64 is intruded into the machine frame in the same direction as the intrusion direction of the roving bobbin exchange machine 10 and the roving bobbin exchanger 64 is operated in follow-up with the roving bobbin exchange machine 10.

Furthermore, in the foregoing embodiment, full bobbins 15A are mounted on the bobbin hangers of the front row and half-exhausted bobbins 15B are mounted on the bobbin hangers of the rear row. Spinning is started in this state. There may, however, be adopted a modification in which spinning is started in the state where medium bobbins 15B are mounted on the bobbin hangers of the front row and full bobbins 15A are mounted on the bobbin hangers of the rear row. Also in this modification, the roving bobbin exchange can be automatically carried out by the roving bobbin exchange machines 10 and roving bobbin exchangers 64 used in the above-mentioned embodiment. In this case, since the roving bobbins of the front row first become exhausted (small bobbins), these exhausted bobbins of the front row are exchanged with full bobbins 15A by the roving bobbin exchangers 64. After the above-mentioned piecing operation is performed by the operator, the full bobbins 15A of the front row are exchanged with the half-exhausted bobbins 15B of the rear row by the roving bobbin exchange machines 10.

The embodiments illustrated in FIGS. 2 through 14 is one for carrying out the method of the present invention automatically by means of the roving bobbin exchange apparatus 10. The method of the present invention can also be carried out without using the roving bobbin switching machine. In this case, a pair of front and rear bobbin hangers are attached to rod-like or plate-like bobbin hanger supporting members, and the supporting members are supported on the creel turnably in the horizontal plane. When the bobbins of the front and rear rows are exchanged with each other, the supporting members are manually turned. In the case where a problem of a narrow space arises, the supporting members are made telescopic so that the length of the supporting member can optionally be changed.

Since exchange of the empty bobbins of the front row with spare full bobbins is very easy, this can be accomplished very simply and promptly by the operator. Full bobbins to be exchanged need not always be hung on the spare rail 4, but they may be prepared in advance on a creel shelf or transporting truck.

According to the present invention, by making the roving wound diameter difference between bobbins of the front row and bobbins of the rear row in roving bobbins to be mounted on the creel at the start of spinning, only bobbins of one of the front and rear rows become small bobbins while bobbins of the other row become half-exhausted bobbins. Accordingly, roving bobbin exchange is performed independently for each row. Furthermore, at the time of exchange of half-exhausted bobbins with small bobbins, no interference is caused between adjacent half-exhausted and small bobbins of the front and rear rows and, therefore, exchange can easily be accomplished even in a narrow space. Also, if the exchange operation is carried out independently for each bobbin hanger so that no tension is imposed on the roving being spun, breakage of the roving is not caused even if the exchange operation is carried out during the spinning operation. Therefore, the exchange can be performed automatically during the operation of the spinning frame.

According to the present invention, small bobbins to be exchanged with full bobbins are located on the front row of the creel, the exchange of small bobbins with full bobbins can be performed very easily. This operation can be carried out very easily and promptly, even manually. Furthermore, since only bobbins of the front row are exchanged with full bobbins, automation of this operation can easily be accomplished.

We claim:

1. In a spinning operation by a spinning frame in which front and rear two rows of bobbin hangers are arranged on a creel, said spinning operation is started after mounting substantially half-exhausted roving bobbins on said bobbin hangers of either one of said front or rear row while mounting full roving bobbins on said bobbin hangers of the other one of said rows, and guiding rovings to the corresponding draft parts from roving bobbins held by said bobbin hangers, a method for switching the relative positions between roving bobbins held by said front bobbin hanger and roving bobbins held by said rear bobbin hangers comprising a cycle of a successive unit operations carried out from one end-side of said spinning frame to the other end-side thereof, each unit operation comprising a first step of displacing by a predetermined distance the axial positions of two bobbin hangers, one of which is located in said front row and the other of which is located in said rear row, which supply a roving to either one of said draft parts disposed adjacently in the lengthwise direction of said spinning frame, to a central point between said two axial positions from respective positions of an initial condition for carrying out the normal spinning operation: a second step of switching said relative position of two bobbin hangers in a condition reverse to said initial condition by displacing them clockwise or counterclockwise along a horizontal circular track having a center located at an identical position to said central point between said two bobbin hangers and a diameter identical to the approached axial distance between said two bobbin hangers in an approached condition, without causing contact of rovings from said two roving bobbins; a third step of enlarging said approached axial distance between said two bobbin hangers to a distance identical to said initial condition for carrying out said spinning operation, said direction of said second step exchange operation being alternatively changed at each cycle of said roving bobbin exchange operation.

2. A roving bobbin exchange method according to claim 1, wherein a cycle of said roving bobbin exchange operation is carried out when said roving bobbins held by said front bobbin hangers or said rear bobbin hangers become exhausted or substantially exhausted, without stopping the normal spinning operation.

3. A roving bobbin exchange method according to claim 2, wherein said predetermined distance of axial displacement between two bobbin hangers in said first step of said unit operation is such that said two bobbins do not contact other adjacent roving bobbins during said displacement-motion along said circular trace.

4. An apparatus for switching the relative position between roving bobbins held by bobbin hangers of a front row and bobbin hangers of a rear row, arranged along a spindle arrangement of a spinning frame, wherein rovings from said roving bobbins are led to the corresponding draft parts of said spinning frame without contacting each other, comprising:

pair of grip mechanisms for holding a bobbin hanger of said front row and a bobbin hanger of said rear row, said two bobbin hangers positioned adjacently;

a supporting member for supporting said pair of bobbin hangers in a slidable condition along the longitudinal direction of said member itself;

a driving mechanism for turning said supporting member;

a cam mechanism for controlling the motion of said grip mechanism for controlling the gripping and releasing motion of said grip mechanisms; and an actuation mechanism for turning said cam mechanism;

said apparatus being capable of displacing along the lengthwise direction of said spinning frame.

5. An apparatus for switching the relative positon between roving bobbins of said front row and said rear row according to claim 4, wherein that said driving mechanism for turning said supporting member is a clutch mechanism which transmits the rotating motion of said cam mechanism.

6. An apparatus for switching the relative position between roving bobbins of said front row and said rear row according to claim 4, wherein said cam mechanism is provided with two cam grooves having a nearly elliptical shape, said grip mechanism being provided with two grippers engaged with said cam grooves respectively.

* * * * *